US006159430A

United States Patent [19]

Foster

[11] Patent Number: 6,159,430

[45] Date of Patent: Dec. 12, 2000

[54] CATALYTIC CONVERTER

[75] Inventor: Michael Ralph Foster, Columbiaville, Mich.

[73] Assignee: Delphi Technologies, Inc., Troy, Mich.

[21] Appl. No.: 09/217,297

[22] Filed: Dec. 21, 1998

[51] Int. Cl.[7] ..... B01D 53/34; B01D 53/88

[52] U.S. Cl. ..... 422/179; 422/180; 422/221; 422/222

[58] Field of Search ..... 422/171, 174, 422/177, 179, 180, 221, 222

[56] References Cited

U.S. PATENT DOCUMENTS 5,787,584 8/1998 Shea et al. ..... 29/890
5,857,140 1/1999 Foster ..... 422/179

OTHER PUBLICATIONS

U. S. Serial No. 09/178,589, Serial No. 08/943,847 and co–pending patent application 09/211,671.

*Primary Examiner*—Hien Tran

*Attorney, Agent, or Firm*—Vincent A. Cichosz

[57] ABSTRACT

A catalytic converter for use in the exhaust system of an internal combustion engine, said catalytic converter including a housing having a cavity formed therein and having a gas inlet end and a gas outlet end, a pair of end members, each of said end members having an opening for allowing exhaust gases to pass therethrough, one of said end members sealingly connected to the gas inlet end of said housing and the other of said end members sealingly connected to the gas outlet end of said housing, a catalyst coated substrate located within said cavity and having a gas inlet face and a gas outlet face, a first mat of material which is expandable in an axially direction when heated positioned between said housing and a first portion of the catalyst coated substrate, and a second mat of material which is expandable in a radial direction surrounding a second portion of the catalyst coated substrate.

9 Claims, 3 Drawing Sheets

CATALYTIC CONVERTER

TECHNICAL FIELD

This invention concerns catalytic converters used for treating the exhaust gas of an internal combustion engine.

BACKGROUND OF THE INVENTION

Pending U.S. patent application Ser. No. 08/928,996, entitled "Catalytic Converter", filed on Sep. 12, 1997, and assigned to the assignee of this invention discloses a converter having a housing with a ceramic honeycomb catalyst coated substrate located within the cavity of the housing. The substrate is characterized in that its inlet face and its outlet face are each formed with a concave depression, and the central portion of the substrate is wrapped with a mat of intumescent material which expands radially when heated by the exhaust gas of an internal combustion engine. The mat extends along the length of the substrate up to the deepest point of the depression in order to protect the fragile end portions of the substrate and prevent them from fracturing when the converter reaches operating temperature. In addition, the end portions of the substrate are configured so as have the peripheral ends thereof in close proximity to end members that are sealingly attached to the opposed ends of the housing. As a result, the concave depressions in the substrate not only form a gas inlet chamber and a gas outlet chamber but, in addition, the opposed faces of the substrate are intended to shield the supporting mat from the hot gases of the internal combustion engine.

Although the concave facial design of the substrate does provide a shielding effect for the support mat to a certain extent, it is clear that a perfect seal cannot be obtained between the ceramic end portions of the substrate and its associated metallic end member. As a consequence, the ends of the main support mat can be subjected to exhaust gases at a temperature which can be in excess of 750 degrees centigrade. The exhaust gases at this high temperature can damage the ends of the mat and eliminate the mica's ability to expand. The ceramic fibers and mica in the mat then become relatively loose and erode away and cause the mat to deteriorate and lose its ability to serve as an insulator and support for the substrate within the housing.

SUMMARY OF THE INVENTION

In order to prevent the heated exhaust gases from damaging the ends of the mat, one example of this invention involves the use of an additional mat of intumescent material positioned at opposed ends of the substrate that expands in an axial direction rather than a radial direction. By so doing, the end portions of the substrate are not subjected to radial forces which could cause the fragile ends of the substrate to fracture as the mat is heated and expands. In addition, inasmuch as the mat at each of the end portions of the substrate expands along the length of the substrate, it exerts a high axial force between the radially expandable mat and the end members and thereby maintains pressure on the ends of the radially expandable mat to prevent erosion thereof. Also by doing so the ends of the axially expanding mat that contact the radially expanding mat are protected from the intense heat. This allows the mica material, at this protected location, to retain its ability to apply a force to the reoriented mat. This force holds the axially expanding fibrous mat material under sufficient pressure to resist erosion, even at the exposed end portions.

Accordingly, in one example the present invention to provides a new and improved catalytic converter in which a catalyst coated substrate is positioned within a housing and is wrapped with mats of intumescent material one of which expands in a radial direction and the other of which expands in an axial direction so as to improve the durability of the mats which serve to support the substrate and prevent excessive heat transfer between the substrate and the housing.

Advantageously, according to another example, the present invention to provides a new and improved catalytic converter having a housing provided with a catalyst coated substrate and end portions thereof wrapped with a mat of intumescent material that expands along the length of the substrate when heated.

Advantageously, another example of present invention provides a new and improved catalytic converter having a housing provided with a catalyst coated substrate and in which the housing is sealed at each end by an end member with portions of the substrate that are located in close proximity to the associated end member wrapped with a mat of intumescent material that expands in an axial direction.

Another example of the present invention provides a new and improved catalytic converter having a housing provided with a pair of end members and having a catalyst coated ceramic substrate located therein with the inlet face and the outlet face of the substrate having a concave depression therein and in which the central part of the substrate is wrapped with a mat of intumescent material which expands in a radial direction when heated and the fragile end portions of the substrate are wrapped with a mat of intumescent material that expands in an axial direction when heated.

Advantageously, according to a preferred example, this invention provides a catalytic converter for use in the exhaust system of an internal combustion engine that includes a housing having a cavity formed therein and having a gas inlet end and a gas outlet end. A pair of end members are provided at the opposed ends of the housing and each of the end members has an opening for allowing exhaust gases to pass therethrough. One of the end members is sealingly connected to the gas inlet end of the housing and the other of the end members is sealingly connected to the gas outlet end of the housing. A catalyst coated substrate is located within the cavity of the housing and has a gas inlet face at one end and a gas outlet face at the other end. A first mat of material that is expandable in a radial direction when heated is wrapped around the substrate and extends along the length of the substrate to cover a first portion of the substrate. In addition, a second mat of intumescent material that is expandable in an axial direction when heated is located between the substrate and the housing at a second portion of the substrate.

In a preferred embodiment, the first mat that is expandable in the radial direction covers the central portion of the substrate and the second mat that is expandable in the axial direction covers the end portions of the substrate. This arrangement is such that the first mat serves as an insulator and support for the substrate within the housing and the second mat provides a seal and insulator which prevents the hot exhaust gases from eroding the ends of the first mat.

BRIEF DESCRIPTION OF THE DRAWINGS

The present invention will now be described by way of example with reference to the following drawings in which.

DESCRIPTION OF THE PREFERRED EMBODIMENT

Figure 1:
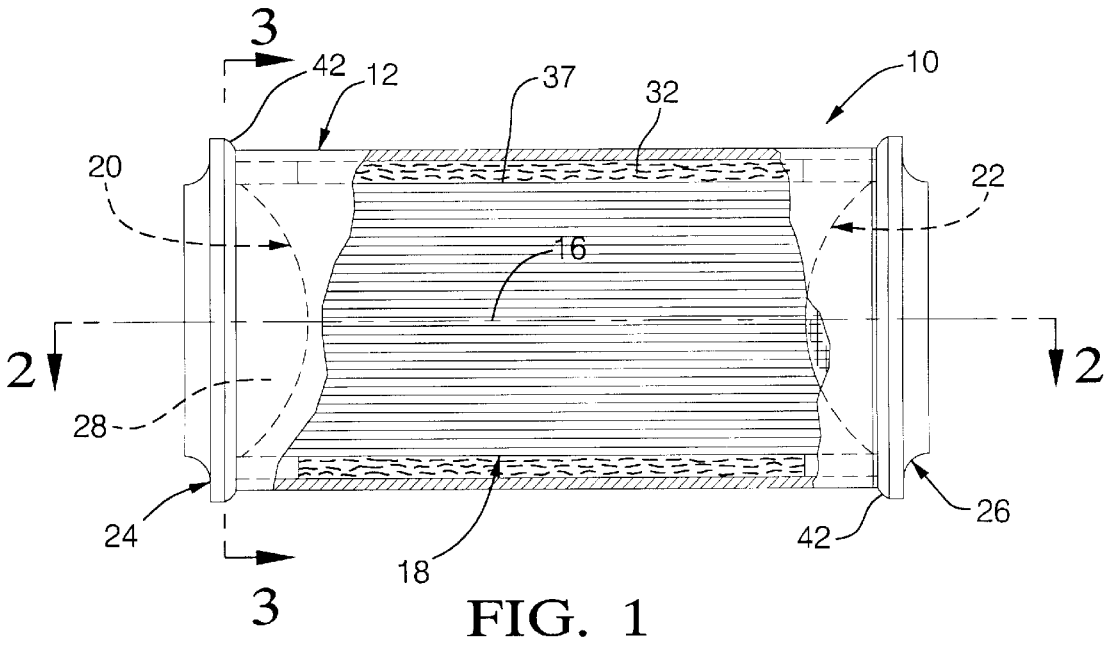
FIG. 1 is a side elevational view of an example catalytic converter made according to the present invention with some parts broken away to show the interior of the converter.

Referring to the drawings and more particularly to FIGS. 1–4 thereof, a catalytic converter 10, made according to the present invention, is shown for use in eliminating the undesirable constituents in the exhaust gases of an internal combustion engine. The catalytic converter 10 has an oval cross-sectional configuration providing a low profile configuration for installation under the vehicle floor or any other space-constrained location of the vehicle. As the description of the invention proceeds, it will become apparent that although all of the examples of the present invention are illustrated and will be described in connection with oval-shaped converters, the converter can have other cross sectional configurations such as round, square, rectangular, or some other cross sectional design and provide the advantages to be discussed hereinafter.

Figure 2:
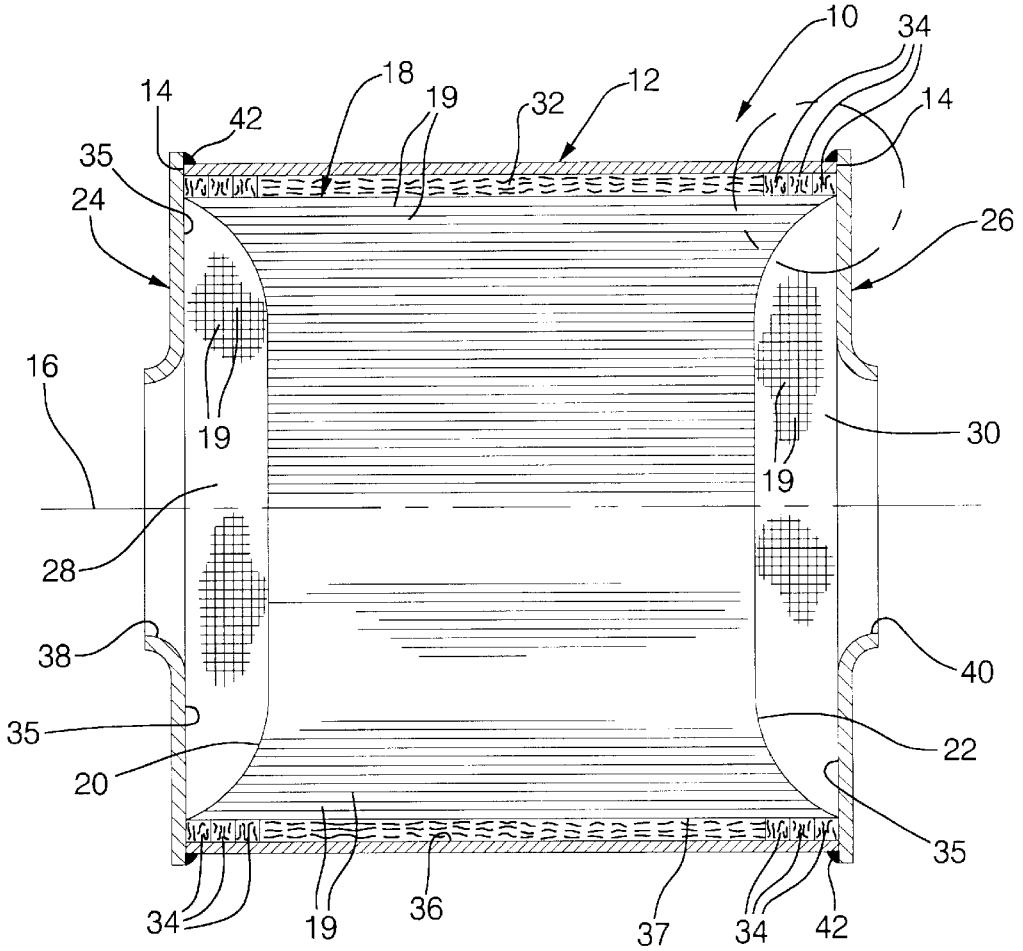
FIGS. 2 and 3 are sectional views taken on line 2—2 and line 3—3, respectively, of FIG. 1.
Figure 3:
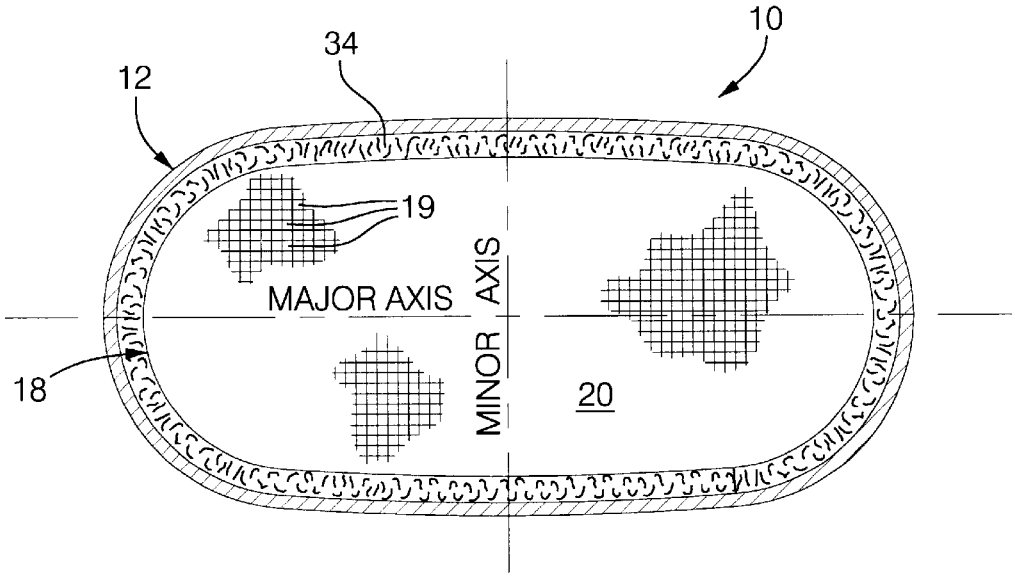

As seen in FIGS. 1–3, the catalytic converter 10 comprises an oval-shaped housing 12 which terminates at each end with an oval-shaped edge 14 defining an oval opening located in a plane extending transversely to the longitudinal center axis 16 of the housing 12. The housing 12 is made from a sheet of stainless steel or other material suitable for operation in a high temperature exhaust environment, and it provides a uniform oval cross-sectional cavity along its entire length. The cavity serves to enclose a monolith or substrate 18 made of a frangible material such as ceramic that is extruded with an identical honeycomb cross-section and an oval periphery. The ceramic substrate 18 is coated with a high surface area material and catalyzed with a precious metal such as platinum and/or palladium and/or rhodium. The catalyst serves to purify the exhaust gases exiting the internal combustion engine by entering the plurality of parallel flow passages 19 within the substrate 18 at the front inlet face 20 thereof and exiting the rear outlet face 22 thereof. The purification of the exhaust gases occurs by reduction and oxidation processes well known to those skilled in the art.

In this regard, it will be noted that the front inlet face 20 and the rear outlet face 22 of the substrate 18 are each formed with a depression for a purpose which will be explained more fully hereinafter. As seen in FIG. 1, the depression is concave in cross section when viewed in elevation. Similarly, the faces 20 and 22 are each generally concave in cross section in plan view as seen in FIG. 2. This configuration of the faces 20 and 22 provides integral portions of the substrate 18 that project outwardly from the body of the substrate 18 resulting in the longest flow passages 19 being located along the outer surface of the substrate 18. From this point, the flow passages 19 progressively decrease in longitudinal length as they approach the center of the depression. Therefore, in effect, both the front inlet face 20 and the rear outlet face 22 each have a portion thereof scooped out to provide the concave depression in each of the faces 20 and 22.

The opposed open ends of the housing 12 are closed by an oval-shaped inlet end member or plate 24 and an identically formed outlet end member or plate 26. The inlet end member 24 cooperates with the depression in the inlet face 20 of the substrate 18 to provide an inlet chamber 28 while the outlet end member 26 cooperates with the depression in the outlet face 22 to provide an outlet chamber 30.

Figure 4:
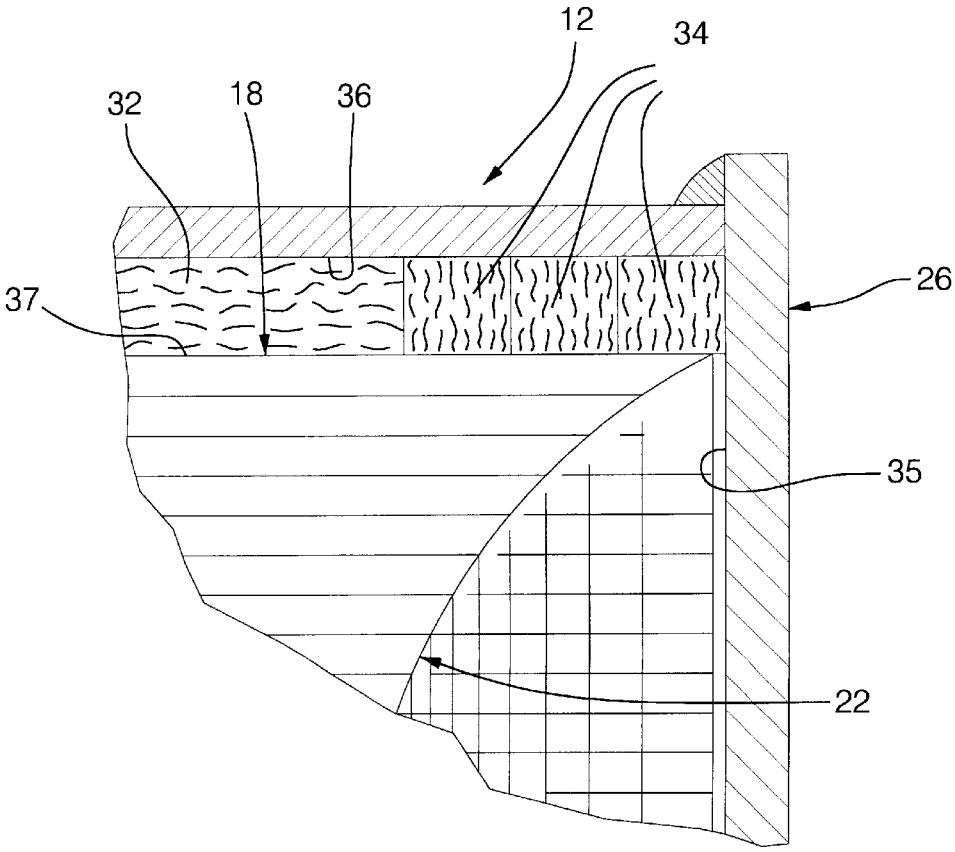
FIG. 4 is an enlarged view of the circled area of the converter seen in FIG. 2.
Figure 7:
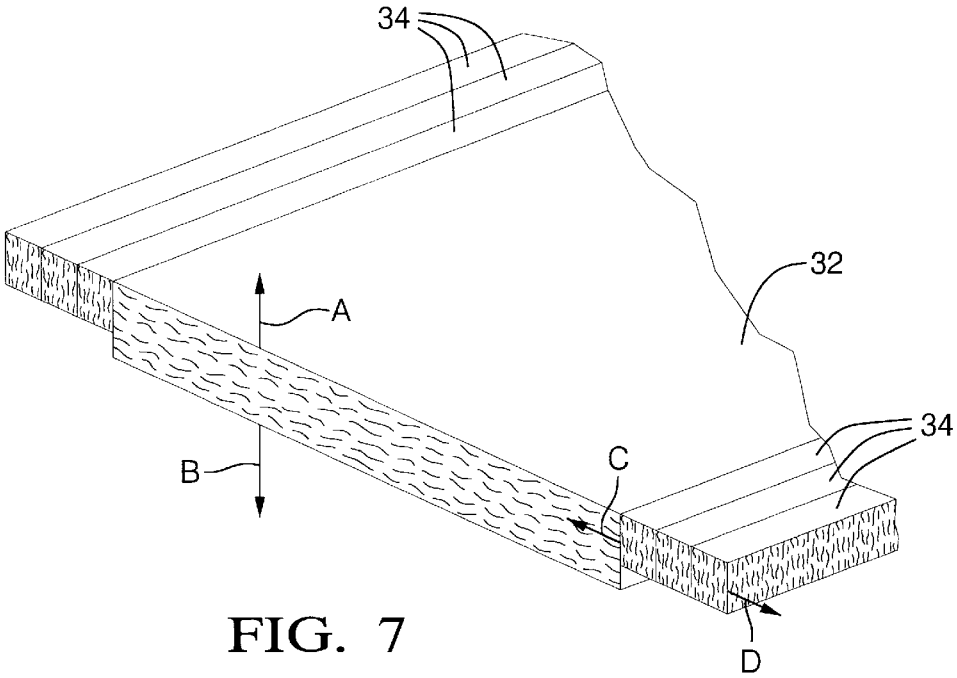
FIG. 7 is a view of the cut sections of the mat seen in FIG. 5 after they are rotated ninety degrees and are combined with the main mat of intumescent material which expands in a radial direction when heated.

As best seen in FIGS. 2–4, the central part of the substrate 18 is supported within the housing by a first mat 32 in the form of an oval-shaped sleeve. The mat 32, as best seen in FIG. 2, extends from the deepest point of the depression in the front inlet face 20 to the deepest point of the depression in the rear outlet face 22 of the substrate 18. Thus, the longitudinal length of the mat 32 is less than the overall longitudinal length of the substrate 18. A second mat composed of three separate sections each identified by reference numeral 34 is wrapped around the end portions of the substrate and fills the area beginning at the end of the mat 32 and ending at the planar inner surface 35 of the associated end member. Both the mat 32 and the mat sections 34 are made from a resilient, flexible and heat expandable intumescent material such as that known by the trade name "Interam". The mat 32 and the mat sections 34 are manufactured by the Technical Ceramics Products Division of 3M Company of Minneapolis, Minn. and are interposed between the inside surface 36 of the housing 12 and the outer surface 37 of the substrate 18. During assembly of the catalytic converter 10, the combined mat 32 and mat sections 34 as seen in FIG. 7, are wrapped around the circumference of the substrate 18 and stuffed into the housing 12. During the stuffing operation, the mat 32 will be subjected to radially applied pressure about its circumference. In addition, the mat section 34 will be subjected to less radial pressure than the mat 32. As will be explained more fully hereinafter, in order to protect the fragile end portions of the substrate 18 that define the depressions within each face 20 and 22 from fracturing during the stuffing operation, the mat sections 34 are dimensioned so that they do not apply excessive radial forces against the outer surface 37 of the substrate 18 during the stuffing operation or while the converter 10 is at operating temperature.

As seen in FIG. 2, the inlet end member 24 includes a circular inlet opening 38 defined by a radius transition adapted to be rigidly connect to a cylindrical exhaust gas inlet pipe (not shown). Similarly, the outlet end member 26 has a circular outlet opening 40 provided with a radius transition adapted to be secured to a cylindrical exhaust gas outlet pipe (not shown) leading to the muffler (not shown) forming a part of the exhaust system in which the catalytic converter 10 is located. The end members 24 and 26 are essentially planar in configuration providing the flat inner surface 35 for engagement with the associated peripheral edge 14 of the oval opening at each end of the housing 12. Also, as shown, the end members 24 and 26 are located in parallel planes that are perpendicular to the longitudinal center axis 16 of the housing 12 and each of the end members 24 and 26 extends radially outwardly beyond the outside surface of the housing 12 for accepting a weld 42 for securing the end member to the housing 12.

It should be noted that the peripheral end portions of the substrate 18 defining the concave depressions in the inlet and outlet faces 20 and 22 are in very close proximity to the flat inner surface 35 of the associated end member. This then allows the outwardly projecting portions of the substrate 18 to substantially shield the space surrounding the substrate 18 and occupied by the mat sections 34. It has been found, however, that a perfect seal is not provided by the projecting portions of the substrate 18 and, in the absence of the mat sections 34, it is possible for the hot exhaust gases entering and leaving the converter 10 to flow from the inlet and outlet chambers 28 and 30 and cause erosion of the opposed ends of the mat 32. In this instance, however, the area around the end portions of the substrate 18 and between the inner surface 35 of each end member 24 and 26 and the associated end of the mat 32 is sealed by the mat sections 34. As a result, the hot exhaust gases do not impinge upon the mat 32 and , therefore, the mat 32 as well as the mat sections 34 can withstand the high temperatures caused by the hot exhaust gases much longer without deteriorating and losing their ability to serve as an insulator and support for the substrate 18.

Figure 5:
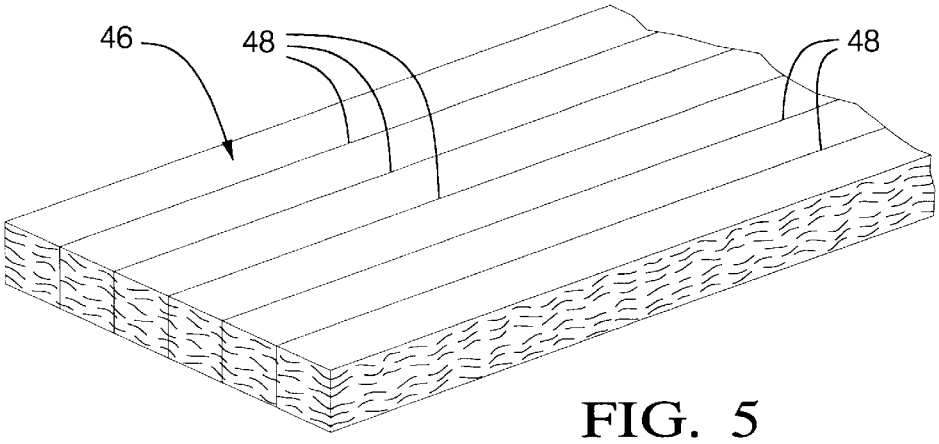
FIG. 5 is an isometric view of a mat of intumescent material used with the converter of FIGS. 1 and 2 that is marked with a plurality of equally spaced parallel lines prior to cutting the mat.
Figure 6:
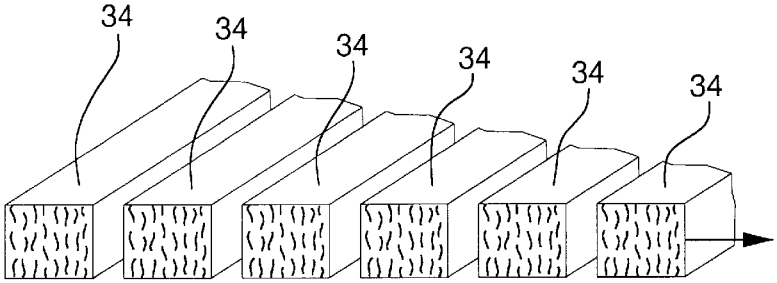
FIG. 6 is an isometric view of the sections of the mat after they are cut from the mat seen in FIG. 5.

In a successful test of a converter made in accordance with the present invention, the concave substrate 18 used was manufactured by Corning Incorporated located in Blacksburg, Virginia and identified as CL100429. The housing 12 was made by Delphi Energy & Engine Management Systems, Flint, Mich. and had an overall length of 162.5 mm. Each of the end members 24 and 26 were 4 mm thick. The housing 12 was designed so as to have a 6 mm uniform gap between the outside surface 37 of the concave substrate 18 and the inner surface 36 of the housing 12. The distance between the deepest point of the concave depression in the inlet face and the deepest point of the depression in the outlet face of the substrate 18 measured 130 mm. The mat 32 of intumescent material made by the aforementioned Technical Ceramics Products Division was identified as 3M Interam 100 having a basic weight of 6200 gram per square meter, a width dimension of 122.5 mm, a length of 430 mm, and a thickness of 10 mm. The mat sections 34 were made from a separate piece of the same 3M Interam 110 sheet 46 of intumescent material which, in this case, measured 430 mm in length and approximately 36 mm in width as seen in FIG. 5. The mat sections 34 were provided by cutting along the parallel lines 48 (shown in FIG. 5) that were spaced from each other by 6 mm. The mat or sheet 46 seen FIG. 5 was then cut along the lines 48 to provide six individual mat sections 34. Each of the six individual mat sections 34 were then rotated ninety degrees so as to have the 10 mm dimension horizontally oriented while the 6 mm dimension is vertically oriented as seen in FIG. 6. Afterwards, three of the mat sections 34 were positioned on opposed sides of the mat 32 as seen in FIG. 7. The mat sections were secured to each other and to the mat 32 by use of a conventional cellophane adhesive tape such as made by 3M or other manufacturers. With the mat sections 34 positioned as seen in FIG. 7, the overall width of the assembled mats was 182.5 mm and the length remained at 430 mm.

It will be noted that, as seen in FIG. 7, the mat 32 has the fibers thereof oriented so that when the mat 32 is subjected to the operating temperature of the converter 10, the mat will expand in the directions indicated by the arrows A and B. On the other hand, inasmuch as each of the mat sections 34 had been rotated ninety degrees prior to being placed in the positions shown in FIG. 7, each of the mat sections 34 will expand in the directions indicated by the arrows C and D. Accordingly, when the mat 32 and mat sections 34 are wrapped around the substrate 18 and stuffed into the housing 12 so as to be located in the positions seen in FIG. 2, the mat 32 will expand radially while the mat sections 34 will expand axially or along the length of the converter 10 when the converter is operating at an elevated temperature. As a result, the mat sections 34 can serve to insulate and seal the opposed ends of the converter and protect the opposed ends of the mat 32 from the high temperature exhaust gases. Moreover, since the mat sections 34 will expand in an axial direction rather than a radial direction, the fragile end portions of the substrate will not be subjected to radial forces which could cause such end portions to fracture. At the same time, the mat 32 serves as a support for the substrate 18 and also serves as an insulator to prevent excessive heat from being conducted to the housing.

In another example of this invention, the inlet and outlet chambers are formed by end plates or end cones and the catalyst substrate faces are not concave but flat. The radially expanding mat covers the central portion of the catalyst substrate periphery and the axially expanding mat covers the end portions of the catalyst substrate periphery. The axially expanding mat prevents excessive mat erosion at the ends of the catalyst substrate by maintaining a high mat density by contacting a radial annular surface of the end plates or cones. The high mat density of the axially expanding mat is made possible by two factors. First the portion of the axially expanding mat next to the ends of the radially expanding mat is protected from the extremely high gas temperatures by the insulated distance from the inlet. This allows this portion of the mat to maintain a high expansion pressure on the remaining axially expanding mat, producing high mat density. Second, the axially expanding mat can be compressed by the end plate or cone during assembly of the converter without concern over applying too much pressure on the substrate, even if a thin wall fragile substrate is used. This is because the compression caused by the end plates or cones is in the axial direction.

In another example, annular end rings can be affixed to the inner periphery of the housing or to the end plates or cones to act as walls holding the axially expanding mat. One annular ring is placed at the inlet end and one annular ring is placed at the outlet end. The annular rings prevent movement of the mat material and provide a surface for the mat to be compressed against.

Various changes and modifications could be made to the above-described catalytic converters without departing from the spirit of the invention. Such changes are contemplated by the inventor and he does not wish to be limited except by the scope of the appended claims.

What is claimed is:

1. A catalytic converter for use in the exhaust system of an internal combustion engine, said catalytic converter including a housing having a cavity formed therein and having a gas inlet end and a gas outlet end, a pair of end members, each of said end members having an opening for allowing exhaust gases to pass therethrough, one of said end members sealingly connected to the gas inlet end of said housing and the other of said end members sealingly connected to the gas outlet end of said housing, a catalyst coated substrate located within said cavity and having a gas inlet face and a gas outlet face, a first mat of material which is expandable in an axially direction when heated and positioned between said housing and a first portion of the catalyst coated substrate, and a second mat of material which is expandable in a radial direction when heated and positioned between the housing and a second portion of the catalyst coated substrate.

2. A catalytic converter for use in the exhaust system of an internal combustion engine, said catalytic converter including a housing having a cavity formed therein and having a gas inlet end and a gas outlet end, a pair of end members, each of said end members having an opening for allowing exhaust gases to pass therethrough, one of said end members sealingly connected to the gas inlet end of said housing and the other of said end members sealingly connected to the gas outlet end of said housing, a catalyst coated substrate located within said cavity and having a gas inlet face, a gas outlet face, and a radial periphery, a first mat of material which is expandable in an axial direction when heated positioned between said housing and end portions of the radial periphery of the catalyst coated substrate, and a second mat of material which is expandable in a radial direction when heated surrounding portions of the radial periphery between the end portions of the radial periphery.

3. A catalytic converter for use in the exhaust system of an internal combustion engine, said catalytic converter including a housing having a cavity formed therein and having a gas inlet end and a gas outlet end, a pair of end members, each of said end members having an opening for allowing exhaust gases to pass therethrough, one of said end members sealingly connected to the gas inlet end of said housing and the other of said end members sealingly connected to the gas outlet end of said housing, a catalyst coated substrate located within said cavity and having a gas inlet face and a gas outlet face, a first mat of material expandable in a radial direction when heated wrapped around said substrate and extending along a first length of said substrate, and a second mat of intumescent material expandable in an axial direction when heated wrapped around said substrate and extending along a second length of said substrate.

4. The catalytic converter of claim 3 wherein at least one of said gas inlet face and said gas outlet face has a depression that is concave in cross section.

5. The catalytic converter of claim 4 wherein said depression is concave when viewed in longitudinal cross section in plan and elevation views.

6. The catalytic converter of claim 3 wherein each of said end members is planar in configuration.

7. The catalytic converter of claim 3 wherein said substrate is oval-shaped in transverse cross-section.

8. The catalytic converter of claim 3 wherein said first mat of material serves to support the substrate within the cavity of the housing.

9. The catalytic converter of claim 3 wherein said second mat of material consists of a plurality of strips of said first mat that have been rotated ninety degrees so as to provide said axial expansion when heated.

* * * * *